US005315854A

United States Patent [19]

Ledebur

[11] Patent Number: 5,315,854

[45] Date of Patent: May 31, 1994

[54] TUBE TAPERING APPARATUS HAVING A VARIABLE ORIFICE DIE

[75] Inventor: Harry C. Ledebur, Canfield, Ohio

[73] Assignee: KW Industries, Inc., Sugar Land, Tex.

[21] Appl. No.: 897,010

[22] Filed: Jun. 11, 1992

Related U.S. Application Data

[63] Continuation-in-part of Ser. No. 472,254, Jan. 30, 1990, abandoned.

[51] Int. Cl.[5] ..... B21D 7/00; B21D 11/08; B21D 37/14

[52] U.S. Cl. ..... 72/297; 72/302; 72/189; 72/285; 72/402; 72/468

[58] Field of Search ..... 72/189, 468, 285, 297, 72/302, 402, 406, 212, 213

[56] References Cited

U.S. PATENT DOCUMENTS

| | | | |
|---|---|---|---|
| Re. 12,515 | 7/1906 | Briede | 72/189 |
| Re. 18,329 | 1/1932 | Neuberth | 72/290 |
| 1,549,527 | 8/1925 | Fielding | 72/189 |
| 1,818,435 | 8/1931 | Smith | 72/402 |
| 1,912,751 | 6/1933 | Batcheller | 72/189 |
| 2,247,863 | 7/1941 | Tiedemann | 72/189 |
| 2,622,652 | 12/1952 | Conroy | 72/402 |
| 3,019,678 | 2/1962 | Le Fiell | 72/7 |
| 3,330,145 | 7/1967 | Adolphi | 72/285 |
| 3,416,346 | 12/1968 | Arrington . | |
| 3,444,715 | 5/1969 | Sellars | 72/285 |
| 3,464,251 | 9/1969 | Johns | 72/402 |
| 3,478,557 | 11/1969 | Tremblay | 72/189 |
| 4,941,342 | 7/1990 | Herndl | 72/402 |

FOREIGN PATENT DOCUMENTS

| | | |
|---|---|---|
| 1058813 | 6/1959 | Fed. Rep. of Germany . |
| 1049663 | 9/1959 | Fed. Rep. of Germany . |
| 2924350 | 4/1981 | Fed. Rep. of Germany . |

*Primary Examiner*—Daniel C. Crane
*Attorney, Agent, or Firm*—Harrison & Egbert

[57] ABSTRACT

An apparatus for tapering a tube having a frame, a tube receiving end connected to the frame, a variable-orifice die arranged so as to be movable relative to the frames, and an axial tension cylinder connected to the tube receiving end so as to apply tension forces to the tube. The variable-orifice die includes a stand having a housing and a plurality of die segments arranged within the housing. The die segments contain a circular groove of varying radius. The die segments define an orifice having an entry plane and an exit plane. The exit plane and the entry plane are offset from the plane of rotation of the die segments. The orifice is truly round in a plane parallel to and offset from the plane of rotation. A motion control processer is interactively connected with the die stand and with the axial tension cylinder for controlling a position of the axial tension cylinder relative to a rate of reduction of the diameter of the tube.

13 Claims, 11 Drawing Sheets

TUBE TAPERING APPARATUS HAVING A VARIABLE ORIFICE DIE

RELATED APPLICATIONS

The present application is a continuation-in-part of U.S. patent application Ser. No. 07/472,254, filed on Jan. 30, 1990, and entitled "Apparatus and Method for Producing Tapered Tubes," now abandoned.

TECHNICAL FIELD

The present invention relates to an apparatus for producing tapered tubes. More particularly, the present invention relates to variable-orifice dies, and apparatus associated therewith, for producing tubes of tapered diameters.

BACKGROUND ART

Tubes of the type having larger diameters at the base and smaller diameters at the top, are often used for street lights, tall signs, etc. Many times, these are made from nested cylindrical tubes of varying diameters which nest within one another and are welded together at their junctions. These techniques are generally slow and expensive and require more metal than necessary for the proper strength. These operations require machinery which is both costly and space consuming.

Alternatively, tubular members are tapered to a variety of useful shapes by conventional swaging operations. In these operations, the uniform wall thickness of the tubular member is swaged to reduce the diameter of the member at selected portions with the consequent result that the wall thickness increases at the reduced diameter portion. The swaging process includes multiple steps which are different and separate from each other. An initial stock must be passed through the step-by-step procedures until it can finally be finished to a desired shape. The steps start with cutting a flat metal blank to a tapered shape, followed by forming it to a tapered tubing with the opposite longitudinal edges left unjoined together. Then, the next step causes the edges of the tubing to be joined together by means of a welding process. Any undesired portions that are present along the welded edges of the tubing are removed by means of a polishing or finishing process. The manufacture of such a product involves many steps, each including different processes. As a whole, a combination of these processes permits the manufacture of the product. However, it is a highly inefficient mass production technique. This swaging process also increases the manufacturing cost for each item.

Single-step swaging processes are also known, in which the swaging machine is specifically designed to provide a small-length tapered metal tubing (such as forks for bicycles). For long tapered tubes which are between 12 and 30 feet long, such as lighting standards, it is practically impossible to implement a single-step swaging process.

Another type of tube tapering machine has been devised wherein tubular metal stock is rotated about its longitudinal central axis. During this rotation, spinning rolls or shoes work on the exterior of the tube to deform it from its initial cylindrical shape to a smaller diameter of either straight or tapered shape. The surface presented against the work piece or tubular stock by the rolls or shoes tends to bend or flex the metal of the tube wall in a direction opposed to its circumferential curve or configuration. This flexing, which is repeated revolution after revolution of the tube, has a tendency to produce longitudinal cracks or to propagate insignificant scratches on the tube wall into cracks. This is particularly true on the inner surface of the tube.

U.S. Pat. No. 3,879,977, issued on Apr. 29, 1975, to F. B. Cauffiel, describes an apparatus and method for producing tapered poles. In this patent, the tapered pole is made from a particular tapered strip which is wound in a pseudo-helical manner on a tapered mandrel. Suitable means are provided for directing and guiding the strip on the mandrel such that the strip is wound from the small end of the mandrel toward the large end. Welding procedures are provided so that the edges of the strips can be formed together so as to produce a tapered pole.

U.S. Pat. No. 3,735,463, issued on May 29, 1973, to A. Merola describes a method of forming tapered tubular members. In this method, a generally uniform wall thickness, hollow, cylindrical body is utilized as the starting material. The body is elongated by engaging the body at two spaced portions along its length. By applying a predetermined force to the body of the engagement portion, a substantial component of the force is directed parallel to the longitudinal axis of the body. When the body elongates between the engaged positions, the wall thickness of the elongated portion is reduced a predetermined amount. The process described in U.S. Pat. No. 3,735,463 was designed for the production of ball bats through a conventional type of swaging process.

U.S. Pat. No. 3,041,990, issued on Jul. 3, 1962, to C. K. Le Fiell describes a tube tapering machine. This machine tapers tubes by using a tool which works on the metal of the workpiece to deform it. This tool is in the form of an annular ring presenting a concave surface or line of contact toward the convex surface of the tubular stock.

U.S. Pat. No. 4,622,841, issued on Nov. 18, 1986, to K. Yoshida shows a single-pass swaging operation. In this invention, several swaging units are arranged in series in a tandem configuration. Each swaging unit includes a flywheel which acts as an anvil. It also includes a set of metal dies. In the tandem configuration, the die sets and the swaging units are arranged sequentially from one to another. On the entry side of the tandem configuration machine, a tubing stock of a prescribed length (which is to be tapered) is inserted, progressing through the machine toward the other side thereof. While the tubing stock is being fed forward, it is sequentially processed by the dies in the swaging unit that provide the tapered shape over the length. After having been processed through all of the dies, the stock is formed to a totally tapered shape.

U.S. Pat. No. 3,330,145, issued on Jul. 11, 1967, to G. F. Adolphi describes a machine and method for tapering rod-like tubular workpieces. In particular, this patent describes the technique in which a cylindrical tube is gripped at both ends and a tension is applied axially to the tube. The tube does not rotate during the forming pass but is rotated at the completion of each pass. This device is generally intended for the manufacturing of tapered tubes having a diameter of less than one inch.

In this Adolphi patent, the die orifice is round on the section through the axis of die segment rotation. At all other sections, it consists of concentric circular arcs with gaps therebetween. The orifice, so formed, is diametrically smaller adjacent to the gaps than at the root of the groove. In this configuration, the workpiece exiting the die is not perfectly round. This causes a limitation in the allowable workpiece reduction. A reverse curvature or concavity is created at the die segment juncture which causes the tube wall to buckle inwardly when subjected to the circumferential compressive force of the drawing operations.

It has been generally found that the Adolphi process may work properly on tubes having relatively small diameters (less than one inch). However, problems can be created using the Adolphi process when used in conjunction with the tapering of tubes having a greater diameter than one inch. It is important to be able t o achieve reductions of between fifteen to twenty-five percent on the diameter of the tapered tube. The reductions in diameters which were achieved by the Adolphi patent would be between 0.010 inch to 0.030 inch on tube diameters of between 0.3 inches and 0.7 inches.

It is an object of the present invention to provide an apparatus and method for tapering tubes that reduces the requirements of die pressure It is another object of the present invention to provide a tube tapering method and apparatus that prevents collapse of the tube wall during the forming process.

It is still another object of the present invention to provide a tube tapering apparatus and method that provides a tapered tube having generally constant wall thickness.

It is still a further object of the present invention to provide a tube tapering apparatus that minimizes space requirements.

It is still another object of the present invention to provide a tube tapering apparatus and method that enables tapered poles to be manufactured at minimal manpower and material cost.

These and other objects and advantages of the present invention will become apparent from a reading of the attached specification and appended claims.

SUMMARY OF THE INVENTION

The present invention is an apparatus for tapering a tube that comprises a frame, a tube receiving mechanism that is connected to the frame, a variable-orifice die that is movable relative to and along the frame, and an axial tension mechanism that is connected to the tube receiving mechanism. The tube receiving mechanism serves to fix the tube in position relative to the frame. The variable-orifice die is suitable for receiving the outer diameter of a tube and serves to reduce the diameter of the tube. The axial tension mechanism applies tension forces to the tube which is fixed within the tube receiving mechanism.

The tube receiving mechanism comprises an anchor grip head that is connected to the frame for receiving one end of the tube and a movable grip head that is connected to the axial tension mechanism for receiving the other end of the tube. The movable grip head is movable relative to the frame The movable grip head also includes a carriage that is rollably connected to the frame such that the movable grip head move relative to the frame.

The variable-orifice die comprises a variable-orifice die stand, a draw carriage that is rollably connected to the frame and supports the die stand, and a draw cylinder that is connected to the draw carriage for moving the variable-orifice die stand along the length of the tube. The variable-orifice die stand comprises a housing, a plurality of die segments that are arranged within the housing, and a die carrier mechanism that is connected to the die segments for moving the position of the die segments in a controlled manner. The die segments have a periphery containing a circular groove of varying radius. The die segments define an orifice having an entry plane and an exit plane. The entry plane and the exit plane are offset from the plane of rotation of the die segments. The orifice is truly round in a plane parallel to and offset from the plane of rotation. The groove has a decreasing radius from the entry plane toward the exit plane. Specifically, the orifice is truly round at the exit plane. The die segments are concentrically arranged so as to define a trumpet-shaped orifice.

The axial tension mechanism comprises a tensioning cylinder that is connected to the movable grip head. This tensioning cylinder is hydraulically actuated for applying a desired amount of axial tension to the tube to be tapered. A squaring die may also be used with the present invention. The squaring die is movable along the frame. The squaring die serves to square the sides of a tapered tube.

The present invention also includes a motion control processer which is interactively connected to the variable-orifice die and to the axial tension cylinder. This motion control processer controls a position of the tensioning cylinder relative to a rate of reduction of the diameter of the tube. Specifically, the motion control processer includes an encoder which is interactive with the draw carriage so as to determine the movement of the die stand. The motion control processer transmits suitable signals for controlling a rate of rotation of the die segments relative to the movement of the draw carriage.

DETAILED DESCRIPTION OF THE INVENTION

Figure 1:
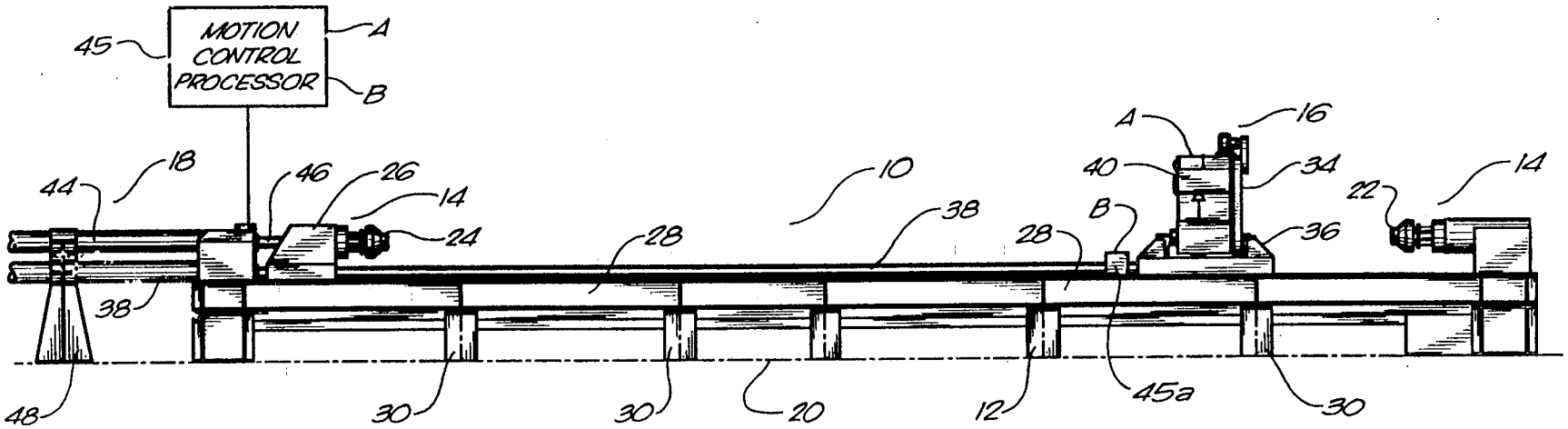
FIG. 1 shows in side elevation the tube tapering apparatus in accordance with the preferred embodiment of the present invention.

There is shown at 10 in FIG. 1 a tube tapering apparatus in accordance with the preferred embodiment of the present invention. Tube tapering apparatus 10 includes frame 12, tube receiving mechanism 14, a movable variable-orifice die 16, and suitable axial tension mechanism 18. The frame 12 supports the tube tapering apparatus 10 above the ground 20. The tube receiving mechanism 14 is positioned so as to receive a long length of a tube of uniform diameter and wall thickness. The tube receiving mechanism 14 is connected to the frame 12. The variable-orifice die 16 is movable relative to and along the frame 12. The interior of the variable-orifice die 16, as described hereinafter, is suitable for receiving the diameter of a tube. The axial tension mechanism 18 is connected to the tube receiving mechanism 14. This axial tension mechanism 18 serves to apply tension forces to a tube which is fixed within the tube receiving mechanism 14.

The tube receiving mechanism 14 includes an anchor grip head 22 at one end of frame 12. The anchor grip head 22 serves to rigidly receive the tube and to fix it in position relative to frame 12. A movable grip head 24 is located generally adjacent the other end of frame 12 of tube tapering apparatus 10. The movable grip head 24 receives the other end of the tube. Both of the grip heads 22 and 24 should have a sufficient capacity to engage the tube and maintain it in proper position during the tensioning of the tube. The movable grip head 24 is supported on a carriage 26. Carriage 26 is mounted on rollers in the bed 28 of frame 12. The carriage 26 is connected to the tensioning mechanism 18.

The bed 28 of frame 12 is of a welded steel construction. This bed 28 can have a sufficient strength to resist the drawn tension forces to be applied to the tube. Preferably, the bed 28 will have machined ways for the rollers of the carriage 26 of the movable grip head 24 and for the carriage of the variable-orifice die 16. A plurality of supports 30 of frame 12 are connected to the bed 28. These supports should be of welded steel construction and should have suitable capacity for supporting the operation of the present invention.

The variable-orifice die 16 comprises a die stand 34, a draw carriage 36, and a draw cylinder 38. The die stand 34 is to be described in much greater detail hereinafter. The die stand 34 includes a housing 40 for receiving the die mechanism. The draw carriage 36 supports the die stand 34. The draw carriage 36 is mounted on rollers in the bed frame 28 and is connected to the draw mechanism 38. The draw cylinder 38 is hydraulically operated so as to move the draw carriage 36. The draw cylinder 38 should be of sufficient stroke for the longest desired tube to be drawn.

The tensioning mechanism 18 includes the tensioning cylinder 44. Tensioning cylinder 44 is connected by rod 46 to the carriage 26 of the movable grip 24. The tensioning cylinder 44 is hydraulically operated. The tensioning cylinder 44 should be o sufficient stroke to accommodate the maximum elongation of the drawn tube. There should also be suitable capacity in the tensioning cylinder 44 to provide room for the unloading of the tube from the apparatus 10. The draw cylinder 38 and the tension cylinder 44 are supported by frame 48 outwardly from the frame 12 of the apparatus 10.

The present invention includes a motion control processer 45 which is provided so as to control the closure of the die orifice on the die stand 34 (to be described hereinafter), the positioning of the tensioning cylinder 44 during the draw, and a monitoring of the draw carriage 36. The motion control processer 45 is electrically interactive with each of these elements so as to provide the necessary controls and monitoring of the system. The motion control processer 45 is utilized in the present invention so as to accurately establish the elongation of the tube and the length and wall thickness of the finished pole.

The elongation of the tube, as it is drawn, is a function of the change in diameter and wall thickness. For any incremental length of draw, the ratio of the tube length exiting the dies to that entering is equal to the ratio of the cross-sectional area of the tube entering to that exiting. The entering tube diameter and wall thickness are initially known, and the exiting diameter is determined by the die orifice diameter controlled by the rotation of the dies. The remaining variable, the exiting wall thickness, is influenced by the axial tension applied to the tube by the tension cylinder 44. Under zero tension, the wall tends to increase. By applying sufficient tension, the wall may be caused to remain unchanged or to decrease.

In actuality, the factor which influences the change in wall thickness as the tube diameter is reduced is the ratio of the axial stress to the yield strength of the material. The axial stress is the applied tension force divided by the cross-sectional area of the tube. It is evident that the exit wall thickness, and therefore the elongation, cannot be exactly established by applying a pre-determined tension force, since the cross-sectional area of the tube is constantly changing as it is tapered, and the increase in the yield strength of material, due to cold-working, cannot be predicted with the required accuracy. These variables result in small variations in the exit wall and the elongation, such that, after several draw passes, the finished length of the tapered tubes may vary. This variation must be compensated for by adding to the programmed length, resulting in additional crop loss.

The use of the motion control processer 45 of the present invention enables this problem to be overcome. The motion control processer 45 is electrically connected to suitable mechanisms on the die stand 34 so as to control the diameter of the die orifice. The motion control processer 45 is also connected to suitable mechanisms on the tension cylinder 44. This system is also combined with an encoder 45*a* so as to read the travel of the die carriage 36. The motion control processer 44 controls the rotation of the die servo motor and the tensioning cylinder servo valve to give the required taper and elongation. The necessary mathematical relationships, such as die motor rotation versus die diameter, will be part of the motion control processer's software. Complete draw sequences, including as many as ten passes to produce a finished tapered tube, will also reside in the computer's memory, so that the operator need only call up a particular program so as to initiate automatic operation.

Figure 2:
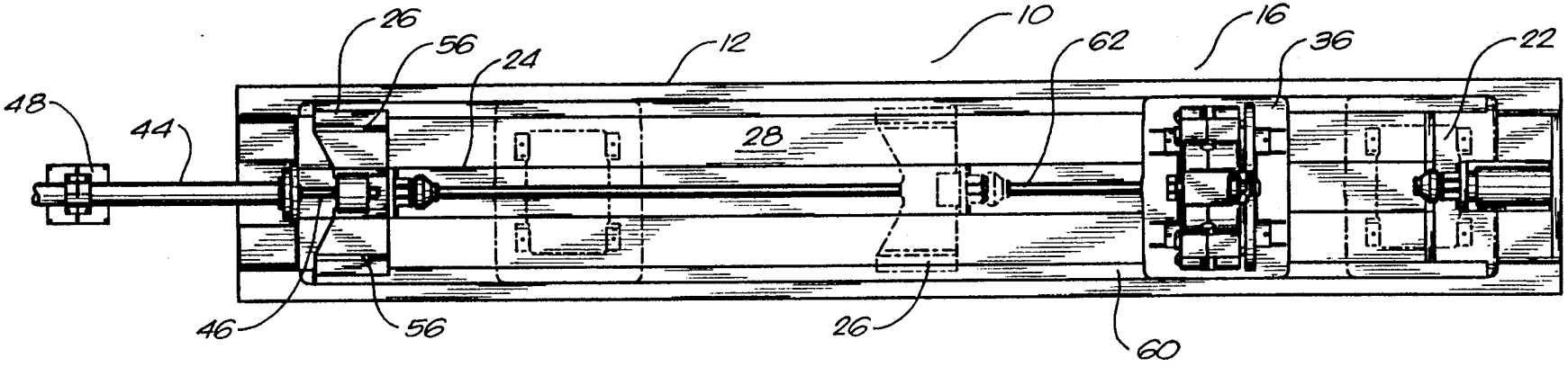
FIG. 2 is a top view of the tube tapering apparatus in accordance with the preferred embodiment of the present invention.

Referring to FIG. 2, there is shown a top view of the tube tapering apparatus in accordance with the preferred embodiment of the present invention. Specifically, in FIG. 2, it can be seen that the frame 12 has a suitable width for accommodating the mechanism of the apparatus. Frame 12 has a generally rectangular configuration. At one end, it can be seen that the anchor grip head 22 is fixedly mounted to the frame 12.

The movable grip head 24 is located at the other end of frame 12. Movable grip head 24 is affixed to carriage 26. Carriage 26 includes suitable rollers 56 that allow the carriage 26 to traverse the machined ways of bed 28. The tensioning cylinder rod 46 engages the carriage 26 and extends into tensioning cylinder 44. Frame member 48 affixes the exterior of tensioning cylinder 44. The dotted illustration of carriage 26 is provided in FIG. 2 to illustrate the length of travel of the carriage 26. When a tube is loaded into the apparatus 10, carriage 26 may reside in the location illustrated in broken line. After the tensioning and drawing operation, during which the rod 46 is drawn into tensioning cylinder 44, the carriage 26 may assume a position illustrated in solid line toward the end of the frame 12.

The variable-orifice die 16 is shown positioned between the anchor grip head 22 and the movable grip head 24. Variable-orifice die stand 34 is affixed to the draw carriage 36. Draw carriage 36 includes suitable rollers so that the draw carriage 36 may traverse machined way 60 of frame 12. Rod 62 extends to the draw cylinder located beneath the tensioning cylinder 44. When suitable hydraulic pressure is applied, the draw rod 62 will pull the carriage 36 of die 16 toward the end of the frame 12. It is the combination of the action of the tensioning cylinder 44 and the draw cylinder 48 that allows for the improved tube tapering operation of the present invention.

Although not illustrated in FIGS. 1 and 2, the tube tapering apparatus of the present invention would preferably include additional features. Those features which are not shown in FIGS. 1 and 2 include a suitable tube loading and unloading device. A tube loading and unloading device would be necessary where the tube is of great weight. The hydraulic pumping station, control valves, and piping to supply power to the drawn tensioning cylinders are not illustrated in FIGS. 1 and 2. Such mechanisms are of conventional configuration. The assembly of such components is well known to those having ordinary skill in the art. An auxiliary hydraulic power unit for the grip heads 22 and 24 and the unloading/loading device would also be desirable. Other items that would be preferable, although not illustrated or claimed, include suitable electric motors and controls, the draw lubricant pumping station and piping, the power track to carry electrical power to the moving die stand, and the power track to carry hydraulic power to the tensioning carriage.

Figure 3:
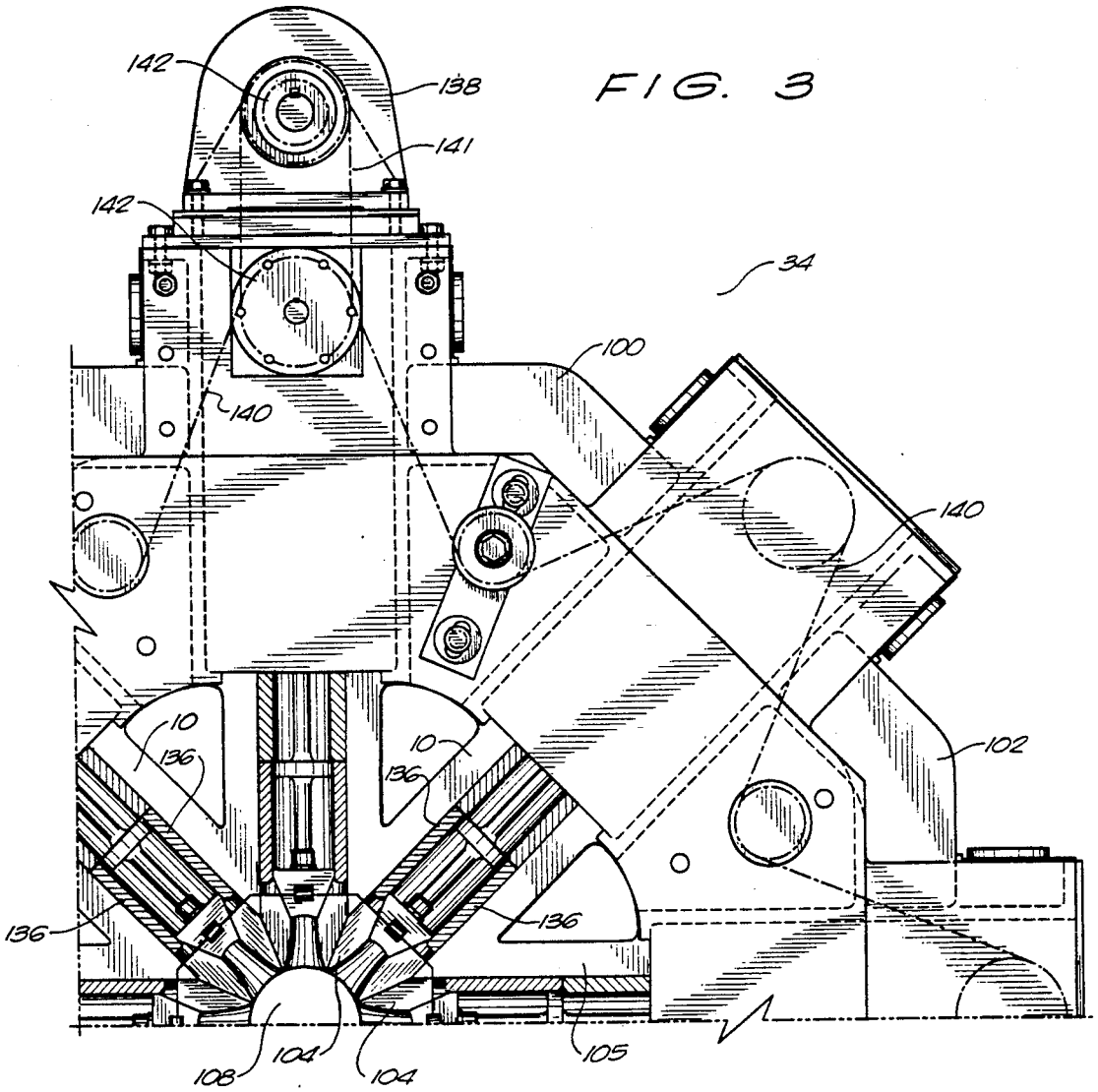
FIG. 3 is a partial cross-section end view of the die stand in accordance with the preferred embodiment of the present invention.
Figure 4:
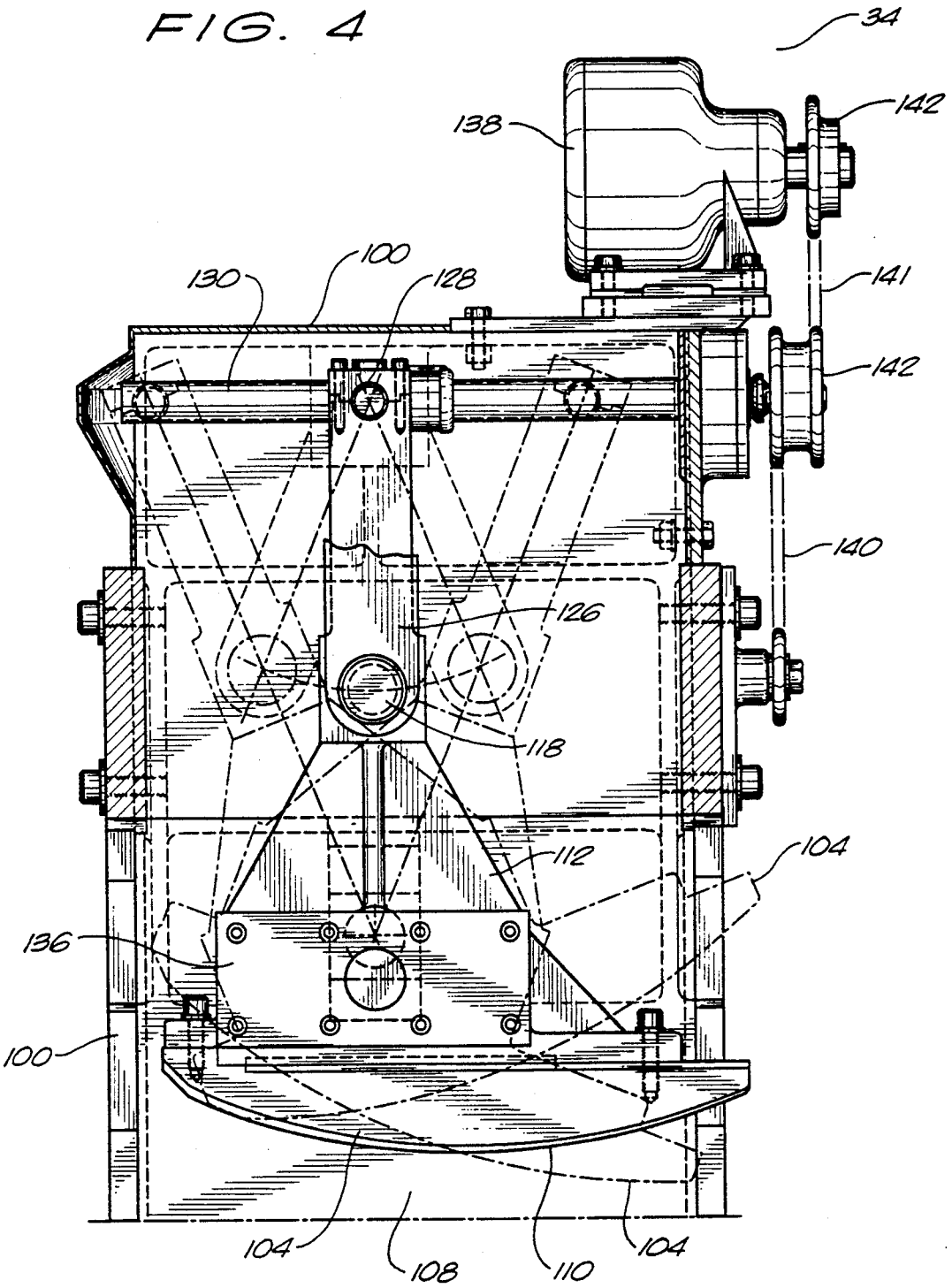
FIG. 4 is a partial cross-section side view of the die stand in accordance with the preferred embodiment of the present invention.
Figure 5:
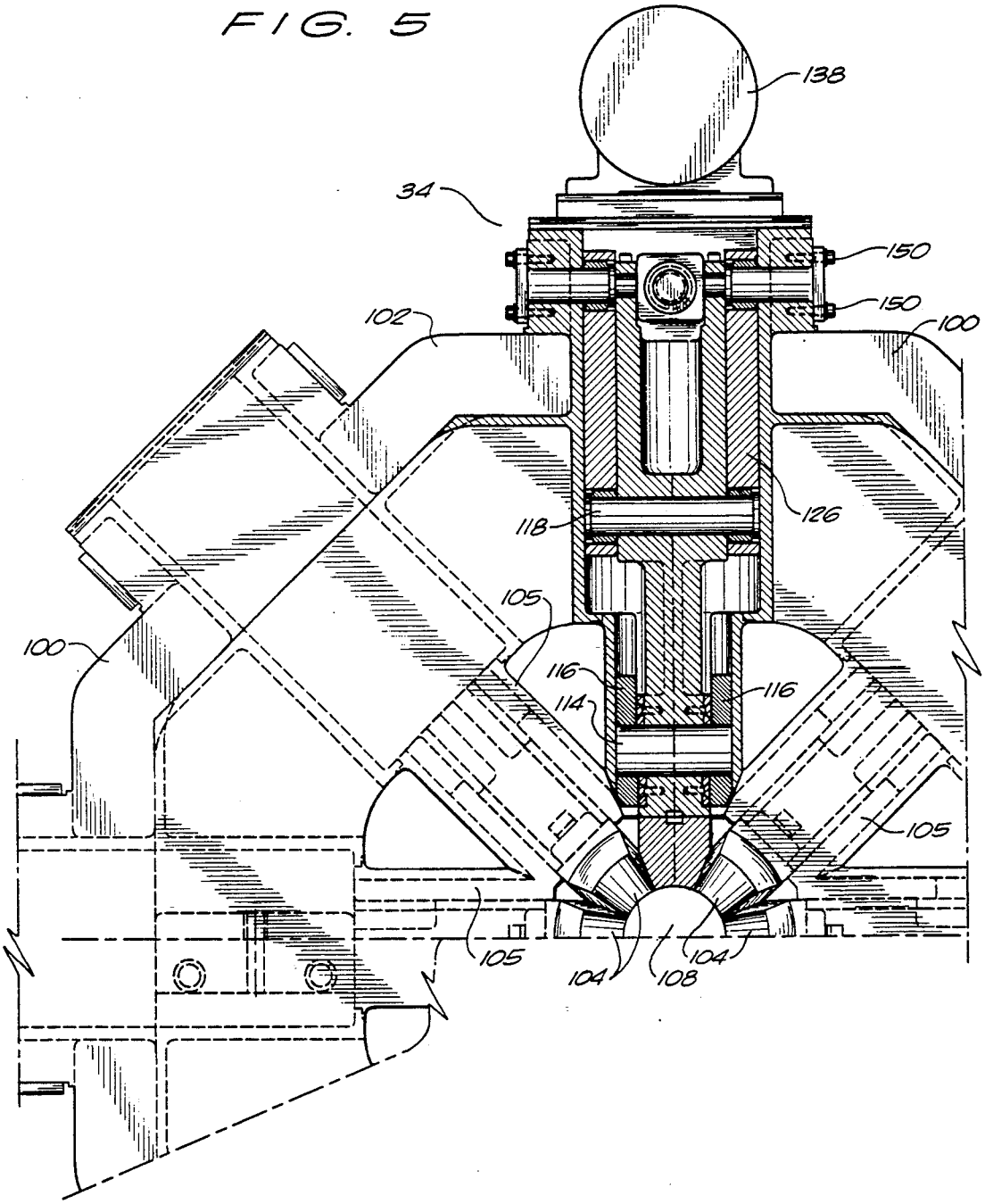
FIG. 5 is a partial frontal view, in cross-section, of the die stand in accordance with the preferred embodiment of the present invention.

FIGS. 3–5 show the general arrangement of the variable-orifice die stand 34 in accordance with the preferred embodiment of the present invention. The die stand 34 is comprised of a fabricated steel housing 100. A fabricated steel housing is comprised of octagonal rings 102. These octagonal rings 102 are bolted to pie-shaped segments 105. In FIG. 3, between the pie-shaped segments 105, in a concentric arrangement at suitable spacing, is the die carrier mechanism which support and move the die segments 104.

The die segment 104 is essentially a segment of a ring whose periphery contains a circular groove of varying radius. The radius of the groove at any section varies in proportion to its angle from the ring center. The thickness of the die segment 104 is sufficient to encompass a forty-five degree sector of the circumference of the maximum tube diameter to be drawn. When the die segments 104 are concentrically arranged around the center of the draw at 108, a trumpet-shaped orifice is formed which serves as a draw die whose diameter may be varied by rotating the die segments. When drawn over the original tube, the die segments are rotated in controlled relationship to the length of the draw. In this manner, a tapered tube is produced. A more detailed discussion of the operation of the die segments is provided in conjunction with FIGS. 9–15.

The configuration of the die segments 104 is best illustrated in FIG. 4. The shape of the edge 110 of the die segment 104 is particularly illustrated. In dotted line fashion, the movement of the die segment 104 is illustrated.

Figure 7:
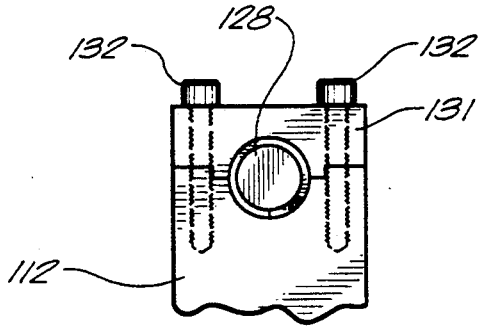
FIG. 7 is a cross-sectional view of a portion of the arm for the die segment.
Figure 8:
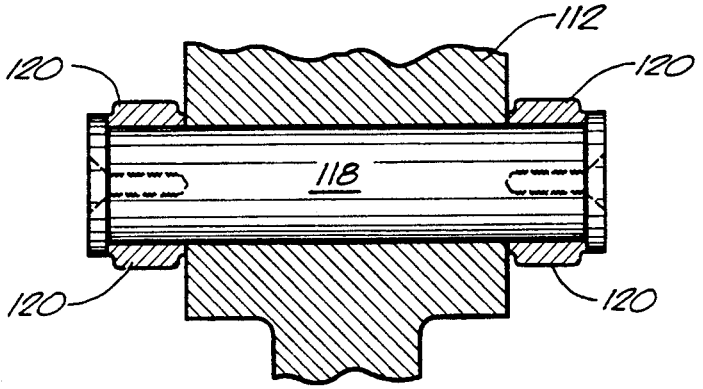
FIG. 8 is a cross-sectional view of the central pin supporting the die segment.

Each die segment 104 is keyed and bolted to an arm 112. Arm 112 is supported at three points. First, arm 112 is supported at the inside by pin 114 (illustrated in FIG. 5). The pin 114 is also supported by a plurality of slide blocks 116. Secondly, the arm 112 is supported at its center by pin 118. Pin 118 is illustrated in greater detail in FIG. 8. Specifically, it can be seen that the arm 112 is connected to pin 118. Pin 118 is supported by a set of roller bearings 120 at each end so as to facilitate rotational movement. The bearings 120 are mounted in levers 126. Thirdly, the arm 112 is supported, at the outside, by a screw trunnion 128. Screw trunnion 128 is illustrated in greater detail in FIG. 7. Screw trunnion 128 is fixed in position between arm 112 and cap 131 by cap screws 132. As the screw 130 (shown in FIG. 4) moves the trunnion 128 back and forth, the die segment 104 rotate by "rolling" along the draw lien. This may be visualized by considering the die/arm assembly as a portion of a wheel of sixty inches diameter rotating about a hub tavelling along the screw. In order to maintain this true rolling action, the levers 126 must be exactly half the length of the arm length between the trunnion 128 and the slide block pin. Each die/arm assembly is restrained against sideways motion by wear plates 136 (illustrated in FIG. 3 and 4). These wear plates 136 slide between the housing segments 104.

The die opening 108 (otherwise known as the draw tube diameter) is therefore a function of the screw rotation. The screws are driven in unison by an electric motor-gear reducer 138. The electric motor-gear reducer 138 is connected to the screw 130 by suitable roller chains 140 and sprockets 142. The thrust of the screws is resisted by suitable anti-friction bearings.

Whereas the die opening 108 is a linear function of the rotational angle of the dies, the die rotation is a non-linear (sine) function of the screw rotation. This must be compensated for in the control of the die drive motor rotation versus the length of the draw. This compensation is necessary so as to obtain the required taper. The motion control processor 45 (as shown in FIG. 1) provides the necessary control on the operation of the dies.

Figure 6:
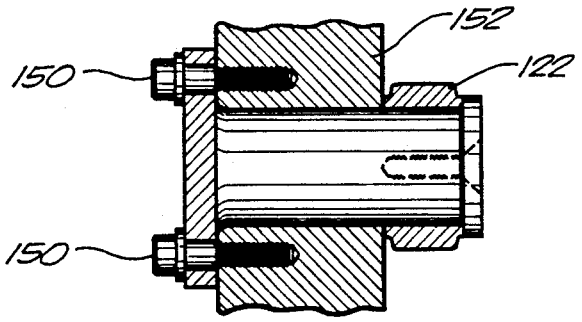
FIG. 6 a cross-sectional view showing the anti-friction bearings and lever of the die segments of the present invention.

The forces on the die segments from the draw operation, which result from the pressure on the die surface necessary to reduce the diameter of the tube as well as the sliding friction, are resisted in the radial direction by the levers 126 which are anchored to the housing 152 by cap screws 150 (see FIG. 6). The bearings 122 (in FIG. 6) also serve to resist sliding friction in the radial direction. The longitudinal forces are resisted primarily by the slide block 116 and the screw 130. To minimize friction, a ball-screw should be utilized. The magnitude of the forces requires substantially heavy construction in these areas.

Figure 9:
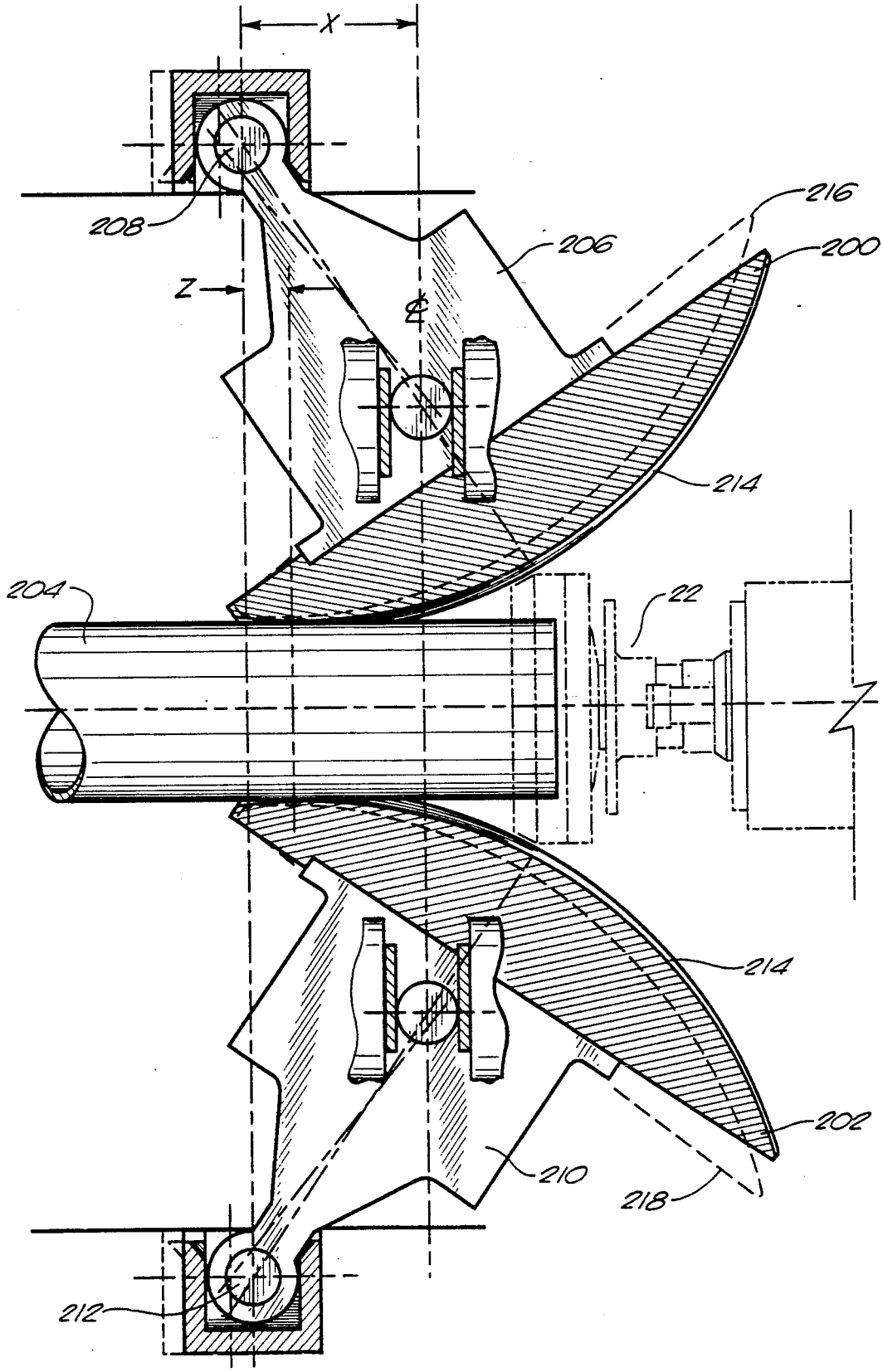
FIG. 9 is a detailed illustration showing the die segments in the maximum open position for the entry of the starting tube.

Referring to FIG. 9, it can be seen that die segments 200 and 202 are illustrated as positioned on opposite sides of a tube 204. The die segment 200 is connected to die holder 206. Die holder 206 pivots about point 208. Similarly, die segment 202 is affixed to die holder 210. Die holder 210 pivots about point 212. The die segments 200 and 202 are the working elements which contact the workpiece 204 and provide the tapering operation. The die segments 200 and 202 are circular segments manufactured from a suitable wear-resistant die material such as hardened tool steel or carbide, with a highly finished working surface. The die segments 200 and 202 are bolted through their respective die holders in a manner to permit easy interchanagability once they are worn beyond their useful life. It also allows for substitution of die segments for different sizes of workpieces.

The working segment of each die segment 200 or 202 is a circular groove of varying radius machined into the periphery 214 of the segments. This configuration is to be described hereinafter. When the number of die segments are concentrically arranged around the center of the draw, a trumpet-shaped orifice is formed. This orifice serves as a draw die whose diameter may be varied by rotating the die segments. The thickness of each die segment is slightly greater than that necessary for the assembled segments to encompass the entire circumference of the largest tube to be drawn. The length of each die segment is sufficient that the groove length will be slightly longer than that required to accommodate the largest to the smallest tube diameter for which the die is intended. For example, die segments designed to taper tubes from a maximum diameter of ten inches to a minimum of 3.2 inches would be approximately three inches thick and thirty-seven inches long. When drawn over the original tube, the die segments are rotated in controlled relationship to the length of the draw. In this manner, a tapered tube is produced.

FIG. 9 particularly illustrates the configuration of the die segments of the present invention in their maximum open position. In particular, the dotted line portions 216 and 218 specifically illustrate the maximum open position of the die segments for the entry of a starting tube 204. The solid line portion of die segments 200 and 202 show the dies in contact with the starting tube at the maximum diameter at the start of the first draw pass. The die segments are illustrated as positioned adjacent to the grip head 22. As can be seen, the die segments 200 and 202 are positioned adjacent to grip head 22. Since the present invention allows the die segments to be placed so close to the grip head 22, the present invention will minimize any crop losses during the manufacture of the tapered tube.

Figure 10:
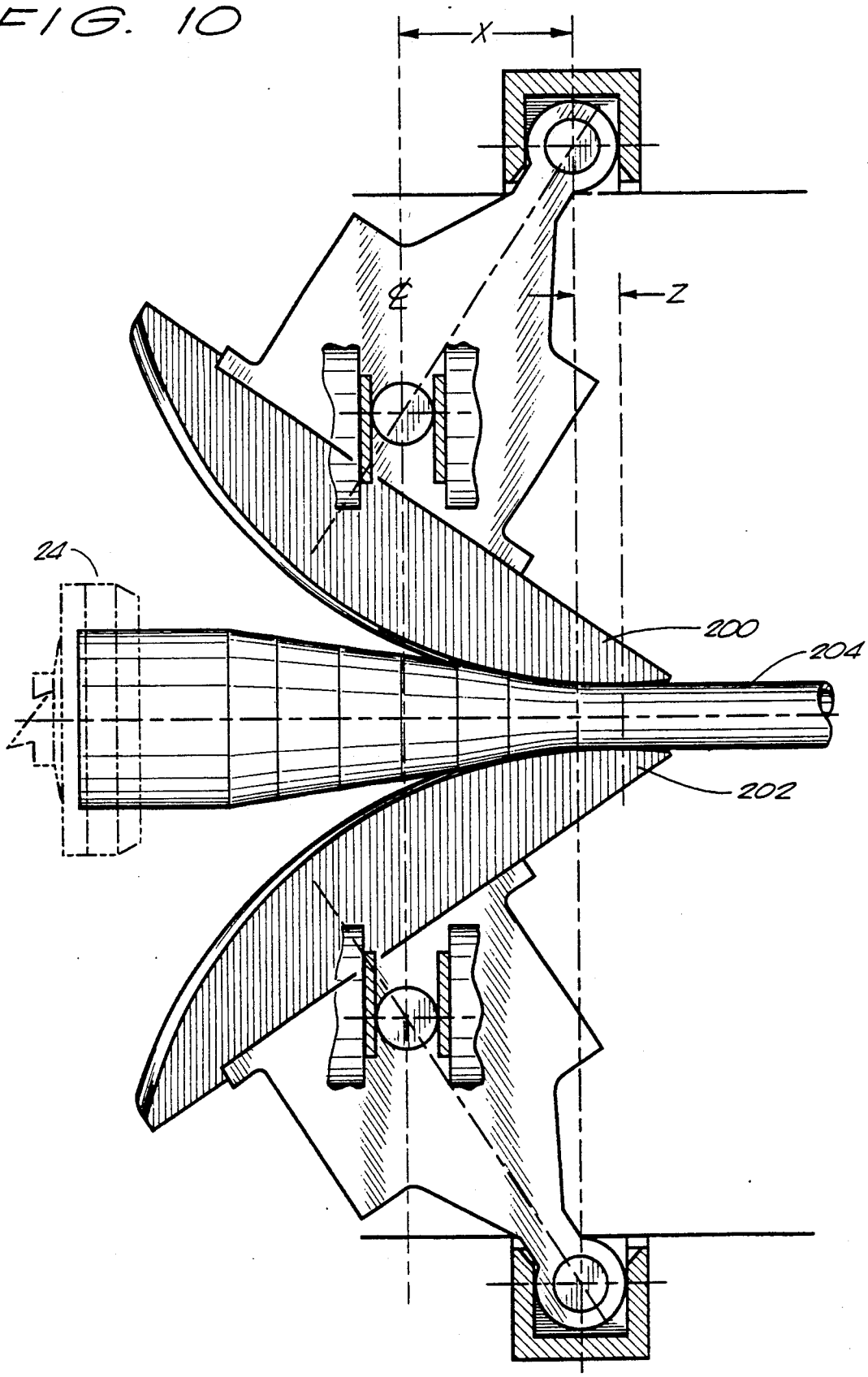
FIG. 10 is an illustration of the position of the dies in the closed position at the completion of the last draw past.

FIG. 10 shows the configuration of the die segments 200 and 202 relative to the workpiece 204 at the closed position at the completion of the last draw pass. In this position, it can be seen that the die segments 200 and 202 are much closer together than they were in the position illustrated in FIG. 9. The die segments 200 and 202 create the minimum diameter portion of the tube 204. Die segments 200 and 202 are shown as terminating adjacent to the movable grip head 24 at the opposite end of the tube tapering machine. The die segments 200 and 202 terminate adjacent to the movable grip head 24 so a to minimize any crop losses from the production of the tapered tubes.

Figure 11:
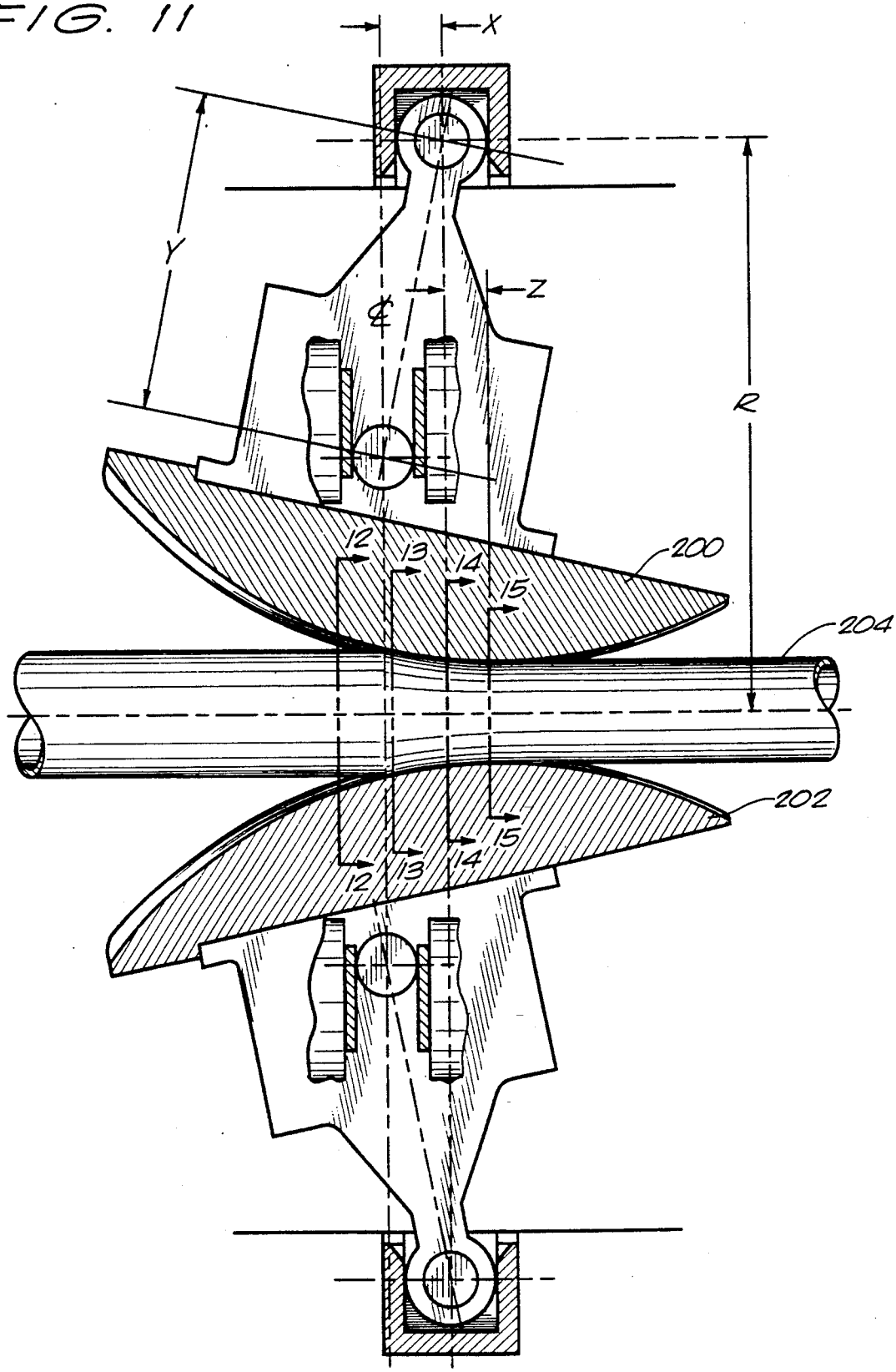
FIG. 11 is an illustration of the position of the die segments during an intermediate draw pass at the maximum theoretical diameter reduction for that pass.

FIG. 11 shows the die segments 200 and 202 in contact with the tube 204 during an intermediate draw pass at the maximum theoretical diameter reduction for that pass. It can be seen in FIG. 11 how the tube 204 assumes its tapered configuration between the die segments 200 and 202. Various cross-sectional lines are illustrated in FIG. 11 through the die orifice normal to the centerline of the draw. Section line 12—12 is shown ahead of the point where the tub 204 first contacts the dies 200 and 202. Section line 13—13 shows the plane where the original tube contacts the dies and reduction of the tube diameter begins. The area shown by section lines 13—13 is known as the "entry plane." Section lines 14-14 are taken through the centers of rotation of the die segments 200 and 202 (the locus of die radius "R"). Finally, section lines 15—15 is the plane where the die orifice is at minimum diameter. This is the area where the effective contact with the drawn tube 204 is ended and reduction is complete. The area identified by section lines 15—15 is called the "exit plane."

It is advantageous in the tapering of tubes to be able to make as large a reduction in diameter as possible in one draw pass. This reduces the number of passes required and the cost of production. An important factor which enables high reductions is the die radius "R" as previously defined, in that the die radius should be as large as possible with respect to the tube diameter to be drawn. The construction of the die stand makes it possible to use a much larger die radius within the same envelope. The construction of the present invention permits the location of the centers of die rotation to be very close to the outer diameter of the die stand. Also, in the longitudinal direction, the die rotation is confined to a space roughly equal to the length of the die segments.

There are four interrelated factors which influence the performance of the dies: the number of die segments; the radius of the die segments "R"; the taper of the radius of the die grooves "K"; and the shape of the die groove. The greater the number of die segments, the less will be the width of the gaps between the die segments where they contact the tube. If the gaps are too large, the tube wall will extrude into the gaps. The radius should be as large as possible because this also minimizes the gaps. The die radius also influences the length of the die contact area with the tube. The groove taper must be selected to give a reasonable degree of die rotation as well as a reasonable overall die length. It also affects the permissible contact length and allowable reduction. The shape of the die groove is of particular importance and its effect on allowable reduction, as illustrated in FIGS. 12-15.

Figure 12:
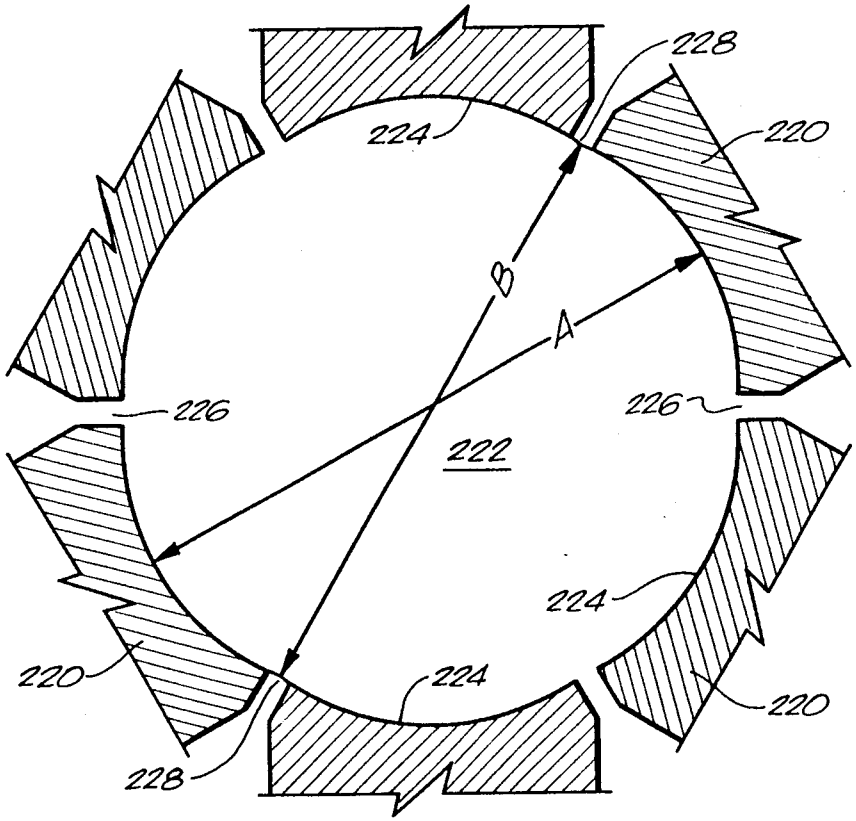
FIG. 12 is a cross-sectional view of the tube and die segments as taken across lines 12—12 of FIG. 11.

FIGS. 12-15 are cross-sectional views in the several planes shown in FIG. 11 through the die orifice normal to the center line of the draw. FIG. 12 shows the configuration of the die segments 220 arranged about the outer periphery of a tube. The die segments 202 define the interior of orifice 222. FIG. 12 illustrates the configuration of the orifice ahead of the point in which the tube first contacts the dies. It can be seen that the die segments 220 have a circular groove 224 and a parting area 226. In FIG. 12, it can also be seen that line "A" shows the diameter at the root of the die grooves 224. Line "B" shows the diameter of the orifice at the die segment parting lines 228.

Figure 13:
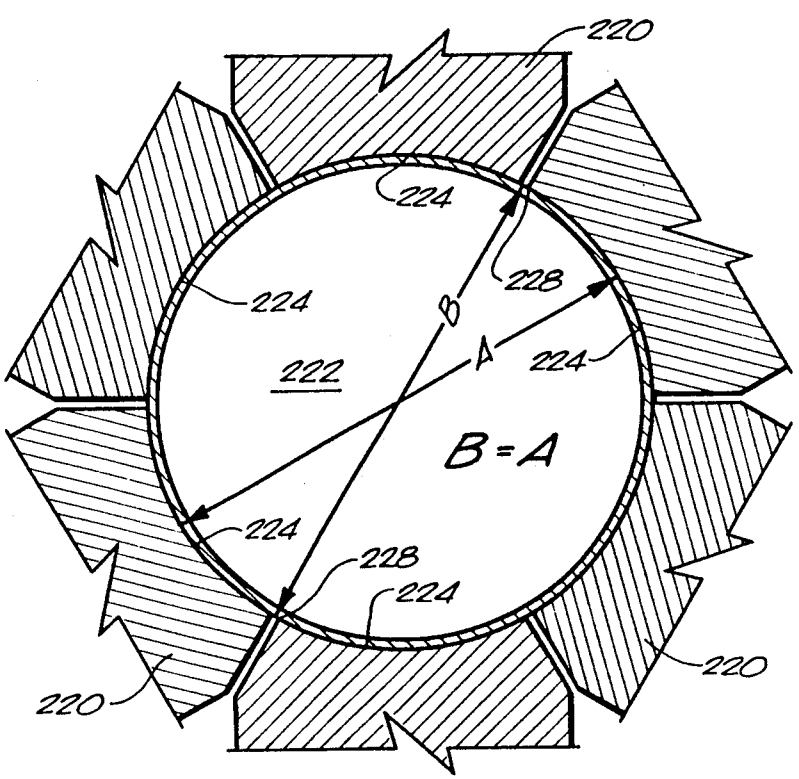
FIG. 13 is a cross-sectional view of the die segments and tube as taken across lines 13—13 of FIG. 11.

FIG. 13 shows orifice 222 in a position in which the dies 220 initially contact the tube with grooves 224. It can be seen in FIG. 13 that the diameter at the root of grooves 224 is equal to the diameter at the parting lines 228. The configuration of orifice 222, as shown in FIG. 13, is the entry plane for the tube within the die.

Figure 14:
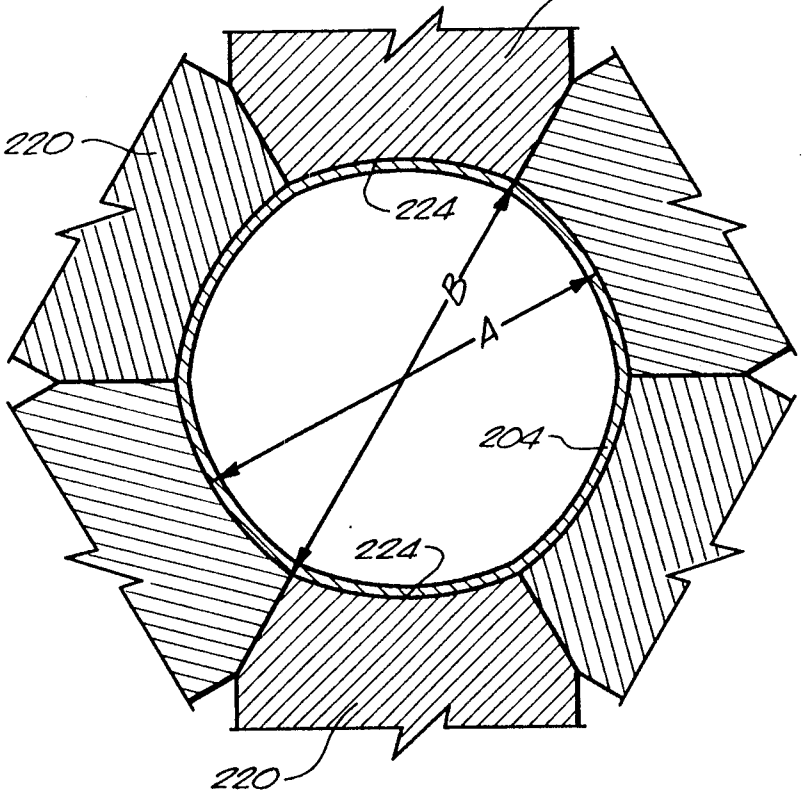
FIG. 14 is a cross-sectional view of the tube and die segments as taken across lines 14—14 of FIG. 11.

FIG. 14 illustrates the configuration of the die segments 220 when the die segments are in coplanar relationship with the plane of the center of rotation of the die segments. The grooves 224 are in compressive contact with the outer wall of the tube 204 in this position.

Figure 15:
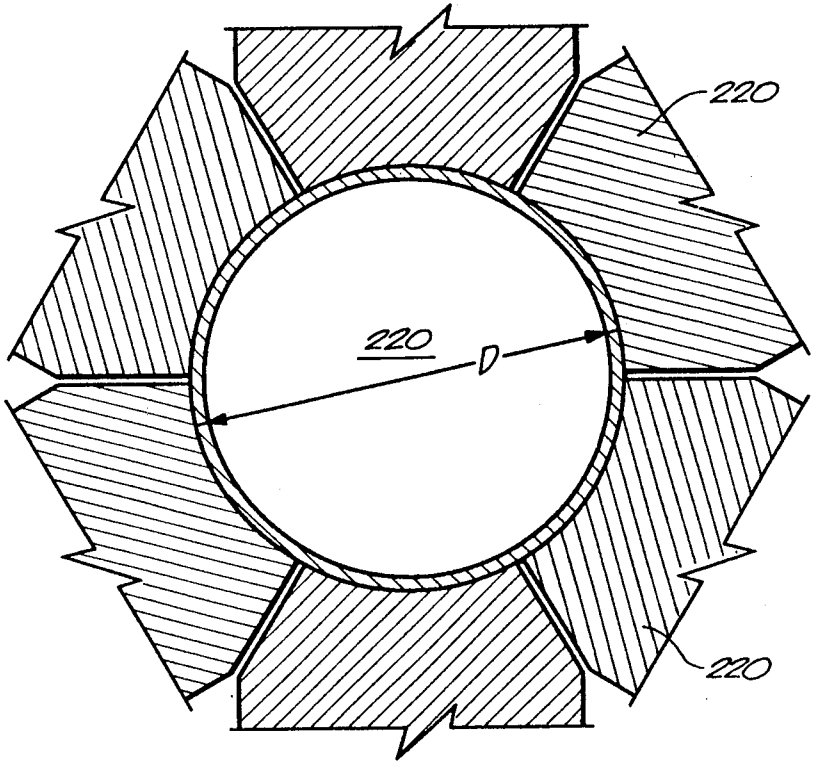
FIG. 15 is a cross-sectional view of the tube and die segments as taken across lines 15—15 of FIG. 11.

FIG. 15 illustrates the configuration of the die segments 220 and the orifice 222 in the plane where the die orifice is at its minimum diameter "D". The position of the orifice 222, as shown in FIG. 15, is where the effective contact with the draw tube 204 has ended. The reduction process is complete in the area shown by FIG. 15. As such, the configuration of the die segments 220 and the orifice 222 is known as the exit plane.

If the variation of the die groove radius is a linear function of the rotational angle of the die segments, calculations have shown that the location of the exit plane (as shown in FIG. 15), that is, its displacement from the plane through the center of die rotation (shown in FIG. 14) is indicated by dimension "Z" in FIGS. 9–11. This is very nearly constant for the full die rotation, from the largest to the smallest tube for which the dies are designed. For example, for dies of 32" radius with grooves capable of a tapering ten inch to 3.5 inch diameter in 70°, "Z" has an average value of 2.65 inches with a variation of approximately 0.003 over the full range of tube diameters.

According to the present invention, the circular groove of varying radius in the periphery of the die segment is, at any cross-section, to be machined truly round in a plane which is parallel to the plane of the rotational axis of the die segment, but offset from this plane in the direction of decreasing groove radius by a pre-determined distance "Z". When the die segments are concentrically arranged around the center of draw, so as to form a trumpet-shaped orifice serving as a draw die, the orifice is round in the "exit plane." The ability to maintain a truly round configuration at the exit plane is important in establishing the diameter of the drawn tube.

As previously noted, for any specific die design, machining of the entire groove may be accomplished with a high degree of accuracy using a fixed value for "Z". The distance "Z" is a function of the die radius ("R"), the maximum and minimum tube diameters to be drawn ("Dmax" and "Dmin") and the die rotational angle ($\theta$) between maximum and minimum diameters. This may be calculated with sufficient accuracy using the following equation:

$$Z = B \cdot \tan\{\arcsin[\sqrt{(B/K)^2 + 1} - (B/K)] \quad \text{(inches)}$$

where:

$$B = R - (D\max + D\min)/4 \quad \text{(inches)}$$

$$K = (D\max - D\min)/\theta \quad \text{(inches/radian)}$$

In contrast to the prior art, the groove configuration of the present invention offers important advantages. In addition to assuring the product, as drawn, will be round, the groove configuration enables a significantly largely incremental reduction for each draw pass. This serves to reduce the total number of passes required to achieve the overall taper.

Specifically, the ability to achieve the desired overall taper in the minimum number of total passes is achieved in the following manner: when the die grooves are machined round in the exit plane, there occurs a cross-sectional plane on the entry side where the die orifice is very nearly round. That is, the diameter of the orifice at the die segment parting lines ("B") is equal to the diameter at the root of the die grooves ("A"), as shown in FIG. 13. This section is identified as the "entry plane." At all other cross-sections, "B" is greater or less than "A". Between the exit and entry planes, "B" will be slightly greater than "A", as illustrated in FIG. 14. This is the area of the die orifice which contacts the workpiece and in which reduction of the diameter of the tube is taking place. The "out-of-round" condition, in this location, is not objectionable because there is no reversal of curvature of the tube wall. However, at all cross-sections ahead of the entry plane (or beyond the exit plane), dimension "B" will be less than "A", as illustrated in FIG. 12. If the tube being drawn were to contact the dies ahead of the entry plane, the wall of the tube would be subjected to a reversal of curvature, that is, bent inwardly, at the die parting lines. Under these conditions, there is a danger that the tube wall will fold inwardly or "collapse" under pressure from the dies. Also, the corners of the dies and the parting lines tend to "dig in" so as to score the surface of the tube.

The location of the entry plane, as with the exit plane, is a function of the die design parameters, that is, the number of die segments, the die radius, the tube diameter, and the die taper. The distance between the entry and exit planes for any die rotational angle can be determined mathematically. Obviously, the greater this distance, the larger the tube entering diameter can be compared to the exit diameter. This means that the diameter reduction capability of the dies is increased, and the die design parameters must be selected accordingly.

In contrast to the prior art, where the die grooves are machined round in the rotational axis plane (i.e., round in the section of FIG. 14), at all other cross-sections dimension "B" is less than "A". and the theoretical entry and exit planes coincide. With this configuration, the allowable diameter reduction is small. This requires more draw passes to achieve the desired taper.

With reference to FIGS. 1 and 2, the operation of the present invention is described hereinafter. Initially, the draw cylinder 38 has its rod 62 fully extended so that the die carriage 36 is positioned adjacent to the anchor grip head 22. The tensioning cylinder 44 is then fully retracted so that rod 46 and the movable grip head 24 are fully retracted generally to the end of the frame 12, as illustrated in solid line in FIG. 2. The opening 108 of the die 16 is fully opened. In addition, each of the grip heads 22 and 24 are fully opened so as to receive the end of the uniform diameter tube.

The uniform diameter tube (otherwise known as the "parent tube") is loaded into the center of the draw between the grip heads 22 and 24. This is typically accomplished by using a suitable loading/unloading device. Using the tensioning cylinder 44 at a slow speed and a low pressure, the parent tube, while still supported by the loading device, is pushed through the die opening 108 of the die stand 34 into the anchor grip head 22. After the tube engages the anchor grip head 22, the tube is in loaded condition. The motion of the tensioning cylinder 44, for the purposes of loading, may be controlled by a manually operated valve. The pressure in the tensioning cylinder 44 is then released when the control valve is centered. Push-button solenoid valves may be used to clamp the grip heads 22 and 24 onto the tube. After this operation is accomplished, the loading device is then retracted.

After the tube is properly loaded onto the machine, the flow of die lubricant is started. The draw passes of the die 16 are then performed sequentially. Each of these passes consists of the following steps. First, the proper tension is applied to the tube. The required cylinder pressure in the tensioning cylinder 44 is set by the controller according to a pre-selected program. Next, the dies are closed to the starting diameter, as established by the control program. The starting diameter of the die will generally be equal to the outer diameter of the uniform tube. The draw stroke of the die 16 is then initiated. During the first portion of the stroke, a tapered section is produced by closing the dies at a controlled rate. Specifically, the die drive motor rotation is a pre-programmed function of the draw carriage position. The control program must account for the non-linear relationship between the rotation of the die actuating motor and the die opening. At a predetermined carriage position, the die closure stops and the remaining length of the tube is drawn at a constant diameter. The draw stroke ends when the draw carriage 36 reaches the slow down and stop switches located on the tensioning cylinder carriage 26. Except for the last pass, the dies are open sufficiently to clear the tube just drawn and the draw carriage is returned to the end of the previously tapered section. The dies are closed to the previously drawn diameter and the next draw pass is initiated. After the last pass of the dies over the tube, the flow of die lubricant is then stopped. The dies 16 are fully opened and the die carriage 36 is returned to its initial position.

After the tube has been appropriately tapered, the loading/unloading device is moved into position to support the tube. The anchor grip head 22 is then unclamped so as to release that end of the tube. By using the tensioning cylinder 44, the tube is withdrawn clear of the die stand 34 to a position controlled by a suitable limit switch. The tube is then gripped by the unloading device and the movable grip head 24 is then unclamped. After the movable grip head 24 is unclamped, the tensioning cylinder 44 retracts the rod 46 and the associated carriage 26 of grip head 24. The tube is then removed by the unloading device.

The present invention will also include certain control interlocks for safety reasons. For example, the initial conditions must be satisfied before the loading sequence is permitted. Grip heads must be clamped before any tension force can be applied to the tube. If the tube should break or any of the grips fail, then the draw must be terminated and the tension pressure removed. Before the draw carriage 36 returns to its original position, the dies must be open. Additionally, the drawn tube must be clear of the die stand and the tension grip head before the unloading device can retract.

The tube tapering apparatus and method of the present invention is intended to produced round tapered steel or aluminum tubes by drawing through a variable-orifice die. According to the present invention, this will occur when a tube of uniform diameter and wall thickness is utilized at the beginning. Square tapered tubes may also be produced by drawing the round tapered sections through a squaring die following the previously identified sequence of operations. The apparatus of the present invention may be used to make a uniform tube taper from end to end. Alternatively, the present invention can be utilized to vary or produce a stepped or variable tapered tube. Additionally, the present invention can be utilized to control the degree of taper in the tube.

The axial tension is applied to the tube during the draw sequence in order to reduce the die pressure and prevent collapse of the tube wall. The collapse of the tube wall could occur when the diameter/wall ratio is high. Another benefit of applying the axial tension is the ability of tension to control, to a limited extent, the wall thickness of the finished tube. Without tension, the tube wall may increase during draw. However, with sufficient axial tension, the wall may be held constant or even caused to decrease.

Instead of the usual method of drawing the tube through a stationary die, the apparatus of the present invention is constructed to draw the die over the tube. This operation, in combination with the axial tension, reduces the draw force and power required. It also serves to reduce the length of the machine.

The foregoing disclosure and description of the invention is illustrative and explanatory thereof, and various changes in the method steps, as well as in the details of the illustrated apparatus may be made within the scope of the appended claims without departing from the true spirit of the invention. The present invention should only be limited by the following claims and their legal equivalents.

I claim:

1. An apparatus for tapering a tube comprising:

a frame;

tube receiving means connected to said frame, said tube receiving means for fixing a tube in position relative to said frame;

variable-orifice die means movable relative to and along said frame, said variable-orifice die means for reducing the diameter of a tube, said variable-orifice die means comprising:

a variable-orifice die stand comprising:

a housing;

a plurality of die segments arranged within said housing, each of said die segments having a periphery containing a circular groove of varying radius with cross-sections taken at spaced points along the length of said groove so as to define said varying radius, said grooves of the plurality of die segments defining a trumpet-shaped orifice having an entry plane and an exit plane, each of said die segments being rotatable about an axis of rotation, said axes of rotation of said die segments lying in a plane, said entry plane and said exit plane offset from and parallel to said plane of axes of rotation of said die segments, said orifice being truly round in said exit plane; and die carrier means connected to said die segments for rotating said die segments in a controlled manner;

a draw carriage rollably connected to said frame, said draw carriage supporting said variable-orifice die stand, said draw carriage having means thereon for moving said draw carriage along said frame; and axial tension means connected to said tube receiving means, said axial tension means for applying tension forces to a tube fixed within said tube receiving means.

2. The apparatus of claim 1, said tube receiving means comprising:

an anchor grip head connected to said frame for receiving one end of a tube; and a movable grip head connected to said axial tension means for receiving another end of the tube, said movable grip head movable relative to said frame.

3. The apparatus of claim 2, said movable grip head comprising:

a carriage rollably connected to said frame such that said movable grip head can move relative to said frame.

4. The apparatus of claim 1, said groove having a decreasing radius from said entry plane toward said exit plane.

5. The apparatus of claim 4, said orifice being truly round at said exit plane, said exit plane being a minimum diameter of said orifice.

6. The apparatus of claim 1, said orifice having a first diameter at a juncture of die segments and a second diameter at a root of said groove, said first diameter being greater than said second diameter at any cross-sectional plane parallel to and between said entry plane and said exit plane.

7. The apparatus of claim 6, said first diameter being equal to said second diameter at said exit plane.

8. The apparatus of claim 7, said first diameter being equal to said second diameter at said entry plane.

9. The apparatus of claim 2, said axial tension means comprising:

a tensioning cylinder connected to said movable grip head, said tensioning cylinder being hydraulically actuable for applying a desired amount of axial tension to a tube.

10. A variable orifice die comprising:

a plurality of interconnected die segments arranged within a housing, each of said die segments having a periphery containing a circular groove of varying radius with cross-sections taken at spaced points along the length of said groove so as to define said varying radius, said grooves of the plurality of die segments defining a trumpet-shaped orifice, each of said die segments being rotatable about an axis of rotation, said axes of rotation of said die segments lying in a plane, said orifice having an entry plane and an exit plane; and die carrier means connected to said die segments for rotating said die segments in a controlled manner, said entry plane and said exit plane offset form and parallel to said plane of axes of rotation of said die segments, said orifice being truly round in said exit plane, said orifice having a first diameter at a juncture of die segments and a second diameter at a root of said groove, said first diameter being greater than said second diameter at any cross-sectional plane parallel to and between said entry plane and said exit plane.

11. The die of claim 10, said groove having a decreasing radius from said entry plane toward said exit plane.

12. The die of claim 10, said first diameter being equal to said second diameter at said exit plane and at said entry plane.

13. The die of claim 10, further comprising:

carriage means connected to said housing so as to cause said housing to move along a fixed surface.

* * * * *